US005179969A

United States Patent [19]

Peterson

[11] Patent Number: 5,179,969

[45] Date of Patent: Jan. 19, 1993

[54] METHOD AND APPARATUS FOR FREE-STANDING WATER REMOVAL FROM ROOF AND SIPHON HEAD THEREFOR

[76] Inventor: David T. Peterson, Roberts Rd., Barrington, Ill. 60010

[21] Appl. No.: 653,683

[22] Filed: Feb. 11, 1991

Related U.S. Application Data

[62] Division of Ser. No. 553,525, Jul. 17, 1990, Pat. No. 5,063,959.

[51] Int. Cl.[5] ..... F04F 10/00

[52] U.S. Cl. ..... 137/1; 137/124; 137/142; 137/559

[58] Field of Search ..... 137/1, 124, 142, 559

[56] References Cited

U.S. PATENT DOCUMENTS

| | | | |
|---|---|---|---|
| Re. 28,491 | 7/1975 | Kundert | 137/142 |
| 4,248,258 | 2/1981 | Devitt et al. | 137/124 |
| 4,406,300 | 9/1983 | Wilson | 137/142 X |

*Primary Examiner*—Gerald A. Michalsky
*Attorney, Agent, or Firm*—Charles F. Meroni, Jr.

[57] ABSTRACT

A roof draining system including a series of portable siphon heads which can be placed anywhere on a flat roof where there is a ponding area that no longer can be drained by any pre-existing water drainage system, a series of upstanding pipes, and a second series of roof top pipes each connected at one end to one of the siphon heads and each connected at an opposite end to one of the upstanding pipes. A control valve structure is connected to the upstanding pipes. The control valve structure has a series of solenoid operated valves each connected to one of the upstanding pipes at one end. Manual discharge valves are each connected at an opposite end of one of the pipe tees. An electrical timer is operatively connected to each of the solenoid operated valves. Siphon pumps are each positioned in line with and operatively connected between one of the solenoid operated valves. The timer is cooperable with solenoid operated valves at timed intervals to cause the solenoid operated valves to open thus permitting city water to pass through the solenoid operated valves and the associated siphon pump, the siphon pumps each having a Venturi jet passageway therein which functions to generate a pressure differential causing roof water to be siphoned from the ponding areas on the roof into the associated upstanding pipe.

16 Claims, 6 Drawing Sheets

METHOD AND APPARATUS FOR FREE-STANDING WATER REMOVAL FROM ROOF AND SIPHON HEAD THEREFOR

This is a divisional of copending application Ser. No. 07/553,525 filed on Jul. 17, 1990, now U.S. Pat. No. 5,063,957.

BACKGROUND OF THE INVENTION

1. Field of the Invention

This invention relates to new and improved siphon heads for draining away accumulated water on a flat roof where conventional water drainage systems fail to allow roofs to drain dry. The invention further concerns a new and improved system for evacuating water from flat roofs where the flat roofs have either a smooth or a rough texture, and different types of siphon heads are provided for achieving this result.

All flat roofs have the potential to develop problems with water standing in low areas especially on older buildings. It has been found that old drain placements made at the time of the original construction of flat roof type buildings often become ineffective due to the settling of the buildings in which event the old drains are therefore no longer effective for removing the water sitting on such roofs. Water weight is heavy at 8 pounds per gallon and water accumulations on flat type roofs can cause the building to settle or sink even further to further damage the building. Water that is deep enough which does not evaporate within 48 hours tends to seep into small pin holes and perforations in the roof membrane trapping moisture underneath its surface which causes a blistering effect when exposed to sunlight and will result in breaking down the insulation and sub structure beneath the roof. All of this damage tends to create the need for an entirely new roof with pitch to cause natural drainage to occur after a rainfall or melting ice. A second flat roof may sometimes be applied if the building can support its weight which requires professional evaluation. A third roof of pitch and gravel over an original roof is never advised.

2. Description of the Prior Art

Various types of water drainage systems have been developed in the past, but none are known that can effectively drain flat roofs dry using various types of siphons for use depending on whether the flat roof has a "rough" or "smooth" roof surface. My new roof drainage systems can be moved about a flat roof of a building to siphon pools or ponds or pools of water at preselected locations to effectuate the draining. Many original roof drains are no longer effective to drain the ponds due to new low spots coming into existence on the roof out-of-effective drain range of existing drains. My invention also utilizes new and improved apparatus and techniques for priming the siphon lines.

Typical examples of prior roof draining systems can be found in a variety of issued U.S. Patents including U.S. Pat. No. Re. 28,491 issued to Robert L. Kundert. This patent discloses a roof draining system that automatically siphons water from roofs that are not completely self draining. While this patent shows a system that works automatically, it fails to disclose how ponds on flat roofs can be drained through the use of portable siphons. This patent also fails to show or teach any siphon heads that are adapted for siphoning rough textured or smooth textured roof surfaces. The Kundert roof draining apparatus operates to suction or siphon sumps that are cut into the roof top which is an expensive approach.

Another example of a drain system for use on flat roofs is shown in U.S. Pat. No. 4,513,768. The roof drain system that is disclosed in this patent does not readily lend itself to draining ponds or pools which have come into existence at a point in time after the original drains have been installed, and where new low spots have come into existence which cannot be readily drained by the drain system that was previously installed.

It has also come to my attention that there are other patents including U.S. Pat. No. 4,171,706 which specifically relate to a method for removing water from a ponding area of a flat roof having a run-off system which is no longer operable to drain water from the ponding area. This patent speaks about the problem that is known to exist in situations where flat roof constructions settle or sag producing so-called low spots which are lower than the areas where the roof is supported which lower areas produce ponding areas when a rain condition commences. These ponding areas tend to increase and have a so-called snowballing effect on the roof since the added weight of the ponding water causes additional sag. It has also been known and found that the existence of standing water on a roof generates added stresses which can cause blistering, leaking and similar problems all of which tend to shorten the life span of a roof. This patent teaches the use of a hose 40 which is "rested upon a ponding surface area of the roof" so that when a rain condition occurs the build up of water in the ponding area will cover the openings 44 (FIG. 4). This hose 40 has a plug 42 that is fixedly secured within the extremity by cement. The plug also has a series of inlet openings 44 which permit the free end portion of the hose 40 to be rested upon a ponding surface area so that when a rain condition occurs the build up of water in the ponding area will cover the openings 44. My invention has a number of features which are not disclosed in this patent, and as a result my water drainage system can be more effectively operated to ponds on drain flat roofs as previously described.

SUMMARY OF THE INVENTION

With respect to the details of my system, it is fully automatic, preferably cycling once per day during the warmest time of day to allow melting ice to be removed as well as summer rain water. In one preferred embodiment, I have found that by employing my new system with four generally flat shaped water siphoning heads located over the four low points of flat roof where needed that a damaged roof can be properly drained without having to construct a new roof thus saving great expense and time loss by avoiding business interruptions of existing businesses in the building. Water lines of 1" plastic pipe are the connected to the siphon heads and are extended over the roof top, resting on the roof top as shown in the drawing and described herein. The pipes all meet at the back side of the building and are brought through the building roof or are brought over the side and down the outside wall or the exterior of the building and ultimately are discharged into outside city storm sewer system.

Certain features of my invention relate to a siphon head for siphoning smooth or rough textured roof surfaces. The heads are each comprised of a soft pliable elastomeric material including a relatively flat foot flange adapted to rest flatwise on a roof to be drained with the flange being annular. A dome shaped head portion is centrally located and integrally formed with the relatively flat foot flange. The relatively flat foot flange is extended outwardly in a relatively flat plane beyond the head portion and surrounding the head portion in all directions, the head portion being closed on its top side and is provided with an interior cavity. An opening is located on an underside of the head portion in communication with the cavity for receiving fluids to be siphoned. A discharge nozzle is disposed in fluid receiving communication with the interior cavity and extends radially away from the head portion atop the foot flange. The discharge nozzle is integrally formed with the head portion and the foot flange and is in supported assembly therewith.

Yet other features of my invention relate to a siphon head for siphoning smooth textured roof surfaces. These heads are each comprised of a soft pliable elastomeric material and which heads have a flat flange portion provided with radially extending lands or ribs with grooves being between the ribs whereby fluid can flow between the ribs while the ribs are engaged upon the smooth textured roof surface.

A further feature of my invention relates to the annular relatively flat foot flange has alternating radially extending lands and grooves, radially inner ends of the grooves opening into the interior cavity, and radially outer ends of the grooves extending through an outer perimeter of the annular relatively flat foot flange, the radially extending lands and grooves providing means for spacing the foot flange above a flat roof surface.

A still further feature of my invention relates to the grooves each being frusto-conical in configuration with the radially inner ends being of a narrower arcuate configuration than the radially outer ends of the grooves.

According to yet other features of my invention, I have provided a siphon head that has a discharge nozzle formed integrally of the soft pliable elastomeric material with a radially inner end of the nozzle being in fluid communication with the head portion and with a radially outer end of the nozzle extending to a radially outer edge of the flat foot flange, and a plastic pipe being telescoped into the discharge nozzle for draining fluids located beneath the flat foot flange and the dome shaped head portion causing the fluid to moves upwardly through the interior cavity and then radially outwardly through the discharge nozzle.

A feature of my invention relates to a new and improved siphon head that is comprised of a soft pliable elastomeric material in which siphon head had a dome shaped head portion centrally located and integrally formed with a relatively flat foot flange with the relatively foot flange extending outwardly in a relatively flat plane beyond the head portion and surrounding the head portion in all planer directions, the head portion being closed on its top side and having an interior cavity, the interior cavity being provided with spaced pads which project downwardly in the cavity and provide means for maintaining a roof of the cavity out of engagement with the roof surface to be drained to allow free flow of fluids from the roof surface into the interior cavity.

Certain other features of my invention relate to a flat roof type building construction which includes a roof having a recessed drain, the drain including an inverted cup-shaped drain member with peripherally spaced elongated drain slots, the improvement of a siphon head comprised of a soft pliable elstomeric material including a relatively flat foot flange adapted to rest flatwise on a roof to be drained, a dome shaped head portion centrally located and integrally formed with the relatively flat foot flange, the relatively flat foot flange extending outwardly in a relatively flat plane beyond the head portion and surrounding the head portion in all directions, the head portion being open on its top side providing an annular edge for nested engagement with the drain with a portion of the elongated slots lying below the edge and other portions of the elongated slots lying above the edge, the edge being in snug nested engagement with the drain while the relatively foot flange is supported on the flat roof.

According to other features of my invention, I have provided an improved roof draining system for use with a substantially flat horizontal roof having a pressurized city-type water line. The improved roof draining system is for draining away water that accumulates on the roof and includes a series of portable siphon heads which can be placed anywhere on the roof where there is a ponding area that no longer can be drained by any pre-existing water drainage system, the roof draining system including a series of upstanding pipes, a second series of roof top pipes each connected at one end to one of said siphon heads and each connected at an opposite end to one of said upstanding pipes, a control valve structure, the upstanding pipes connected to the control valve structure, the control valve structure involving a series of solenoid operated valves each connected to one of the upstanding pipes at one end, pipe means connected to each of the solenoid operated valves at one end, the pipe means being connectable with the pressurized city type water line, pipe tees each connected at one end to an associated one of the solenoid operated valves, manual discharge valves each connected at an opposite end of one of the pipe tees, an electrical timer operatively connected to each of the solenoid operated siphon pumps each positioned in line with and operatively connected between one of the solenoid operated valves and the associated pipe tee, the timer being cooperable with solenoid operated valves at timed intervals to cause the solenoid operated valves to open thus permitting city water to pass through the solenoid operated valves and the associated siphon pump, the siphon pumps each having a Venturi jet passageway therein which functions to generate a pressure differential in a region of the pipe tee causing roof water to be siphoned from the ponding areas on the roof into the associated upstanding pipe and then through a discharge valve inlet which flow continues from the roof ponds until the roof ponds are drained dry, the timer being operable at predetermined intervals to automatically shut off the solenoid operated valves after the interval expires.

My invention further concerns a new method of removing ponds of accumulated water from a flat roof where existing drainage systems are unable to reach new low roof spots lying beneath the ponds that have come into existence after the existing drainage system was installed, moving water drainage siphon heads to each of the ponds, connecting flexible water pipes to each of the siphon heads, connecting the flexible water pipes to a water drainage or sewer line, providing a Venturi jet having an orifice of an order of ¼" in fluid communication with each of the flexible water pipes, and causing pressurized water of an order of 50 P.S.I. to flow into each of the Venturi jets to generate a siphoning action in the flexible water pipes to such water from each of the ponds to assist in draining of the ponds.

DESCRIPTION OF THE DRAWINGS

The various features and embodiments of my invention will be better understood from the following detailed description when considered with reference to the accompanying drawings, in which.

DETAILED DESCRIPTION OF THE DRAWINGS

Figure 1:
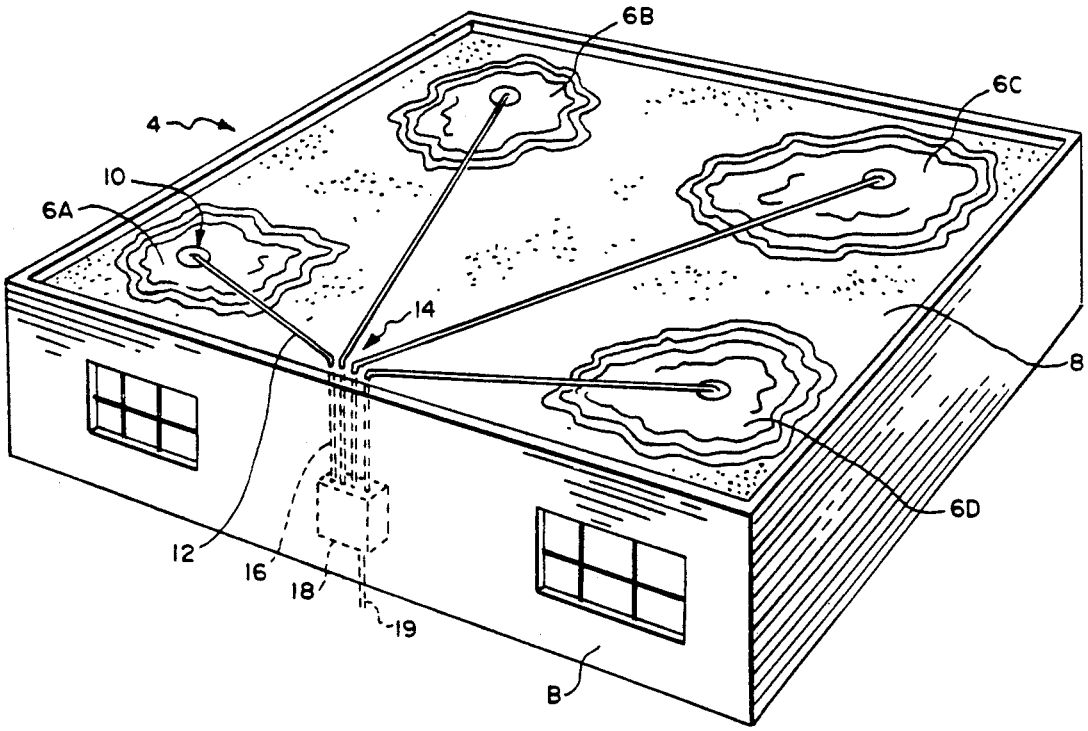
FIG. 1 is a top perspective view of a flat-roofed building upon which four siphon heads are strategically placed, with interior connection to my siphon valve system within the building according to important features of my invention.

A typical building 4 having a flat roof is depicted in FIG. 1. In this view, it is assumed that, through settling with age and the weight of standing water, the building 4 has developed low spots at points 6A, 6B, 6C, and 6D upon its flat roof 8. In these areas, water is shown to have ponded in a manner which defies complete drainage by conventional, generally accepted means or by the means of previously installed water drainage systems (not shown).

Siphon heads 10 can be placed in the approximate centers or apparent lowest locations in the ponded areas illustrated. Each siphon head 10 can be connected by a plastic pipe 12 to a convenient juncture 14 in the roof 8 where, through a standard sealed collar, the group of pipes cna be plumbed to upstanding pipes 16 (illustrated by dotted lines) inside the building leading to a valve housing or structure 18 also located inside the building 4. Through a network of valves and pipes within the housing 18, the drained water is discharged to an appropriate outlet 19 into a conventional storm sewer system (not shown).

Figure 2:
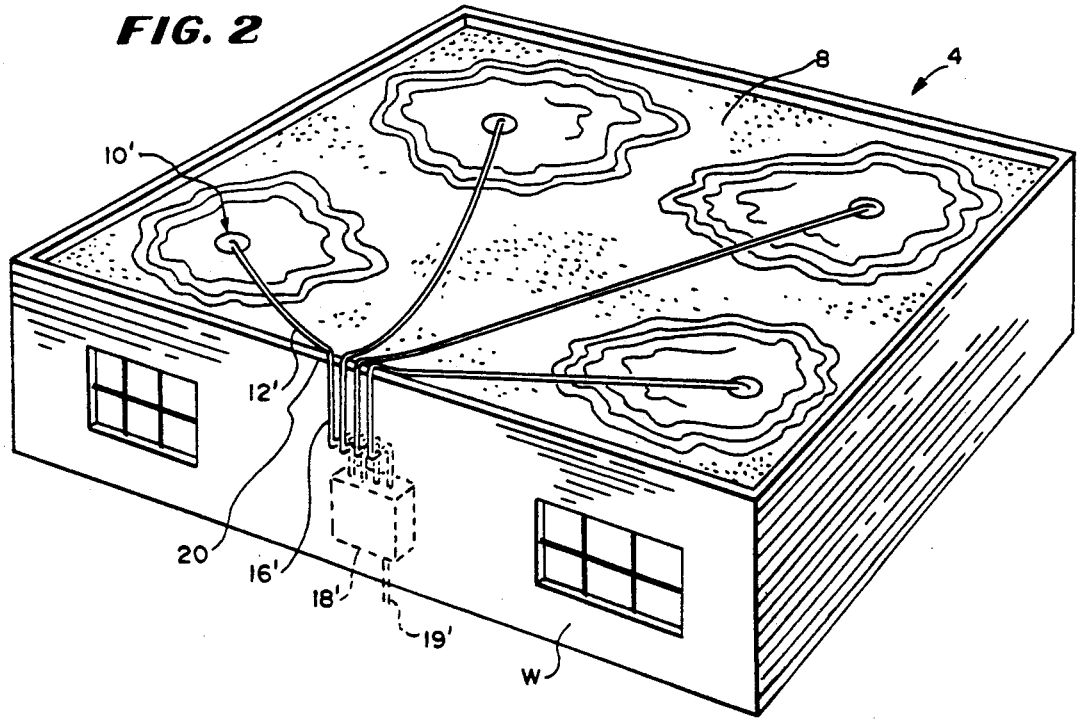
FIG. 2 is a top perspective view of a flat-roofed building upon which four siphon heads are strategically placed, with exterior connection by a modified piping arrangement to a siphon valve system within the building.

In FIG. 2, a similar building with a flat roof is shown with piping 12' from siphon heads 10' over a roof cap 20 to upstanding pipes 16'. These upstanding pipes lead downward through an exterior wall inside the building to a valve housing 18', into the valve system, and ultimately to the outlet or drain 19'.

In milder non-freezing climates, it is more desirable to install all of the valves for causing the jet action in the water pipes, on the inside of the building. It may also be desired to install the electrical controls on the exterior of the building.

Figure 3:
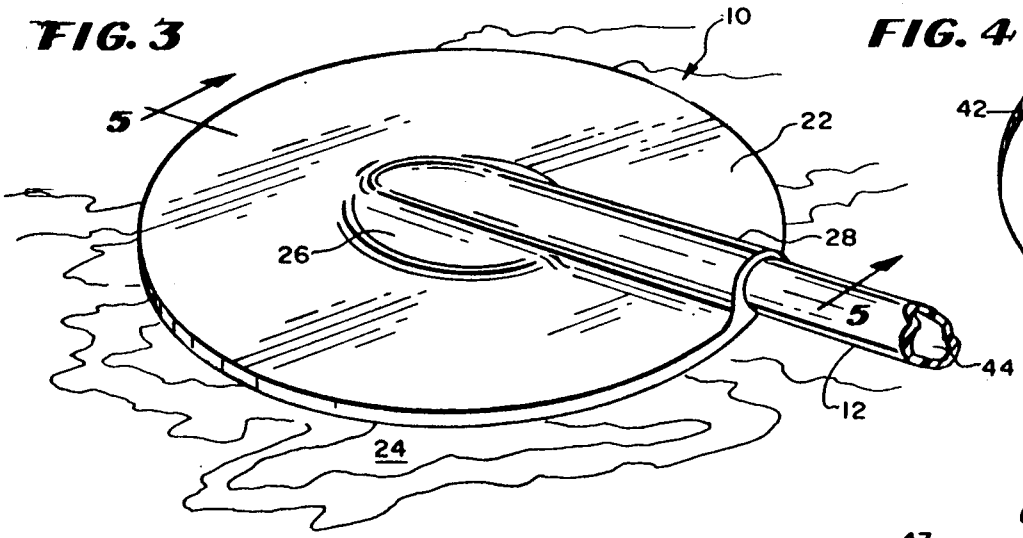
FIG. 3 is a top perspective of a single siphon head designed for use on flat roof tops where comprised of stone and/or gravel in tar or of other rough, rather irregular characteristics, the head embodying certain important features of my invention.

The siphon head 10 is shown in a top perspective view in FIG. 3. The head 10 is made in one piece from an elastomeric material preferably from a relatively firm rubber and is about 22 inches in diameter. The head 10 has a flat foot-flange 22 with a thickness in a range from $\frac{3}{8}$ inch to about $\frac{1}{2}$ inch and is to be set down flat in ponded water 24 (FIG. 3). At its center, the head 10 has a somewhat raised portion 26 which is molded integrally with a discharge nozzle 28 and the plastic drain pipe 12 can be inserted therein.

Figure 4:
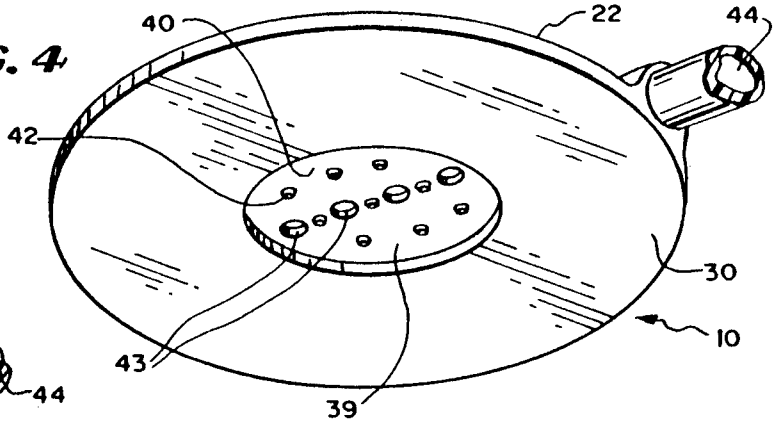
FIG. 4 is a bottom perspective of the single siphon head shown in FIG. 3 and illustrating the head having a flat bottom for use on irregular, rough surfaced roof tops such as those comprised of stones in tar.
Figure 5:
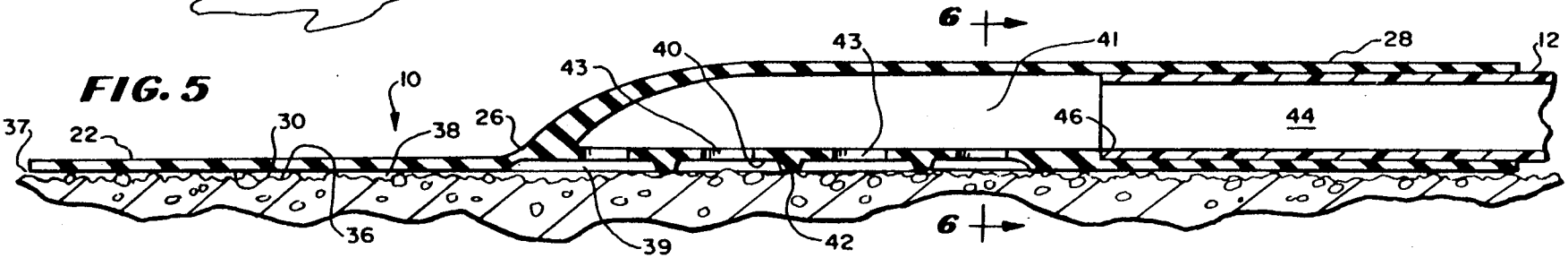
FIG. 5 is a vertical section through the siphon head on line 5—5 of FIG. 4 in a plane parallel to the radially molded discharge portion.
Figure 6:
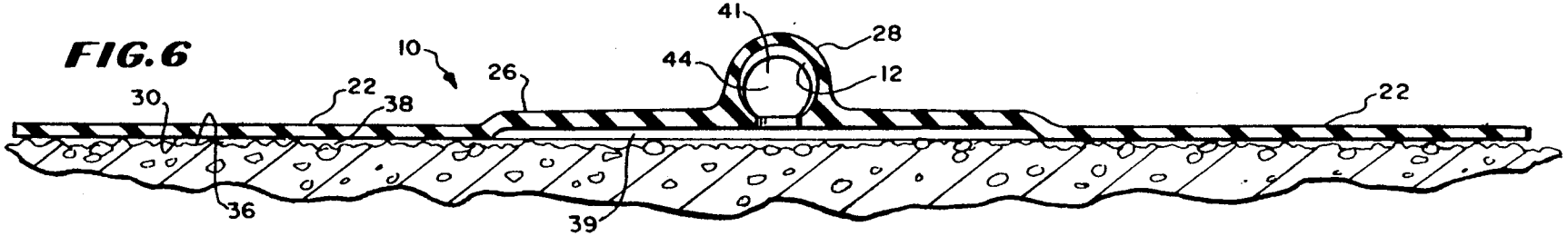
FIG. 6 is a vertical section through the siphon head on line 6—6 of FIG. 5, taken across the discharge portion.

The construction depicted in FIG. 4 has a flat bottom 30 which communicates with a rough roof surface 36 (FIG. 5), usually consisting of small stones laid in tar. Gaps 38 between the non-yielding flat bottom 30 and the rough roof surface 36 provide a straining action as water passes through and around them in the restricted space between the surfaces. Leaves and debris are prevented from entering a peripheral crease 37 (FIG. 5) created between the surface 36 and the head 10. Water is drawn from the ponded area into the narrow space beneath the foot-flange 22, toward the hub or raised portion 26 which has a lower circular interior cavity, or lower chamber 39. The foot-flange 22 is preferably $\frac{3}{8}''$ to $\frac{1}{2}''$ thick. The lower chamber 39 can be manufactured having an 8" diameter and being approximately $\frac{1}{2}''$ in its vertical dimension between a roof 40 and surface 36 (FIG. 5). The roof 40 of this cavity has integrally formed support buttons 42 preferably of $\frac{1}{2}''$ diameter and $\frac{1}{2}''$ in vertical dimension protruding downwardly from the roof in an arrangement which gives support to the roof upon the surface 36.

Positioned directly above the lower siphon head chambers 39 is an upper siphon head chamber 41 which is also in axial alignment with a horizontal axis of the pipe 12 to facilitate fluid flow from lower axial pipe passageway 44 in the pipe 12.

The roof 40 has ports 43 disposed in a row through which water is passed into the interior passageway 44 of discharge nozzle 28 and the pipe 12. Excellent results can be attained where these ports are manufactured with a ⅝" diameter and where passageway 44 has a 1" diameter. A molded-in lip 46 prevents the pipe 12 from entering too far into the upper chamber 41 the discharge nozzle where it might otherwise block the ports.

Figure 8:
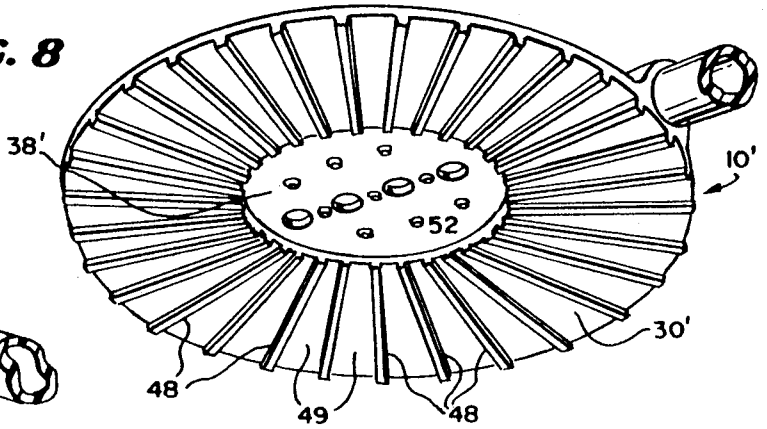
FIG. 8 is a bottom perspective of the single siphon head shown in FIG. 7 with radially extending ribs in its bottom surface which permit water flow on a smooth surface.
Figure 7:
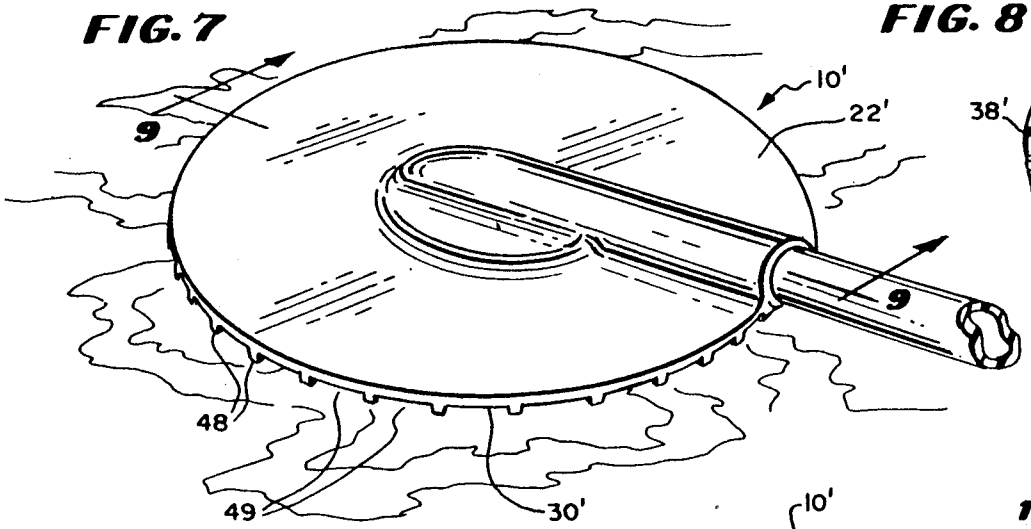
FIG. 7 is a top perspective of a modified single siphon head for use on a flat, smooth roof surface, the modified head embodying certain other important features of my invention.
Figure 9:
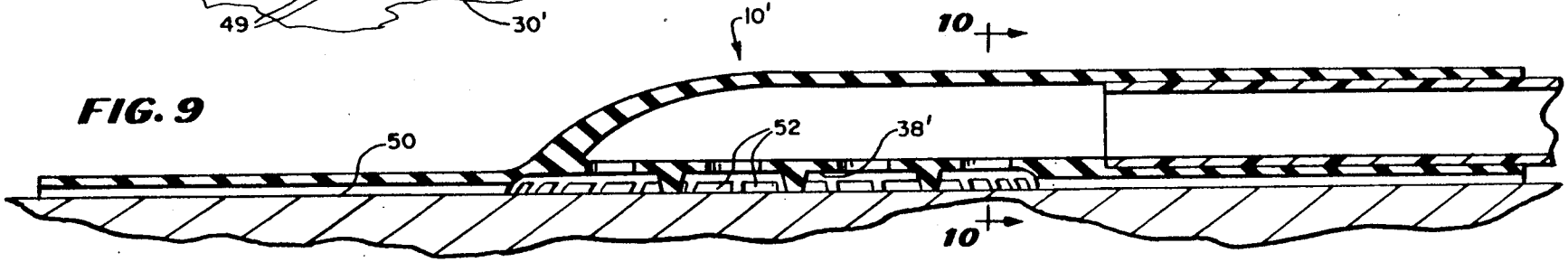
FIG. 9 is a vertical section through the siphon head on a line 9—9 of FIG. 8 in a plane parallel to the radially formed discharge portion.
Figure 10:
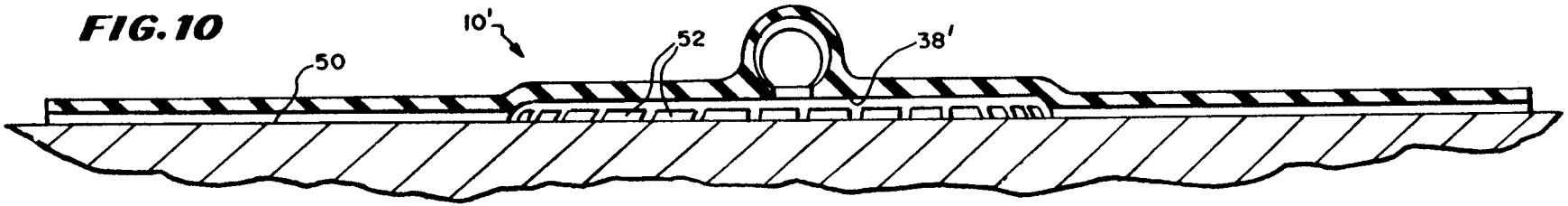
FIG. 10 is a vertical section through the siphon head on a line 10—10 of FIG. 9 through the discharge portion.

In FIGS. 7 and 8, it is apparent that the flat foot-flange has upon its bottom surface 30', a series of uniformly spaced integral radial extending ribs 48 each preferably having a ⅛" height provide water flow paths frusto-conical or passageways 49 between the ribs when this siphon head 10' is placed upon a flat roof surface 50 for which it is designed. The hub cavity 38' is the same as in the flat-bottomed siphon head 10 only designed to contact rough roof surfaces. However, in this instance the ribs 48 converge into the cavity forming peripheral openings 52 (FIGS. 8, 9) through which water enters (FIGS. 9 and 10). Buttons 42' serve also to support head roof 40' above the flat roof 50.

The siphon head 10' shown in FIGS. 7–10 functions and operates very similarly to the siphon head 10 illustrated in FIGS. 3–6. The main difference between the two embodiments is that the foot flange 22' is provided with the ribs 48 and the grooves 49. The function and operation of the siphon head 10' is otherwise essentially identical to the one previously described. In both forms of my invention, as will be observed from a consideration of FIGS. 3–10, the pads 42 and 42' serve as means for preventing the siphon action or vacuum action from drawings the siphon head roofs 40, 40' against the flat roof of the building. If the flat roofs 40, 40' were not provided with the heads 42, 42', there might be some tendency for the roofs 40, 40' to pull down and contact the flat roof of the building so that the flow of liquid or water on the flat roof through the super imposed siphon chambers might be impeded.

Figure 11:
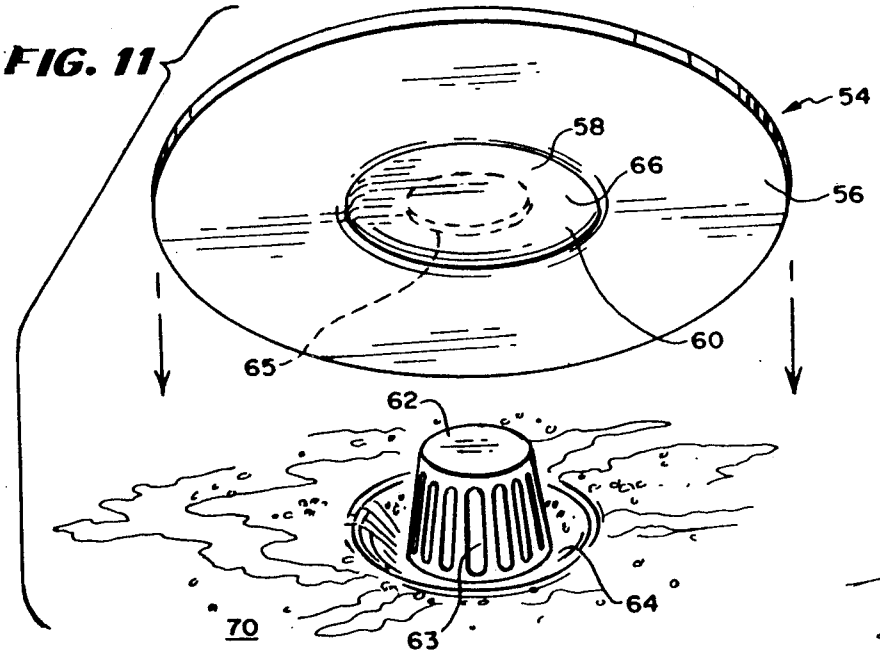
FIG. 11 is a bottom perspective illustrating another embodiment of siphon head constructed for use in conjunction with an existing roof drain unit and which head concerns yet other features of my invention.
Figure 12:
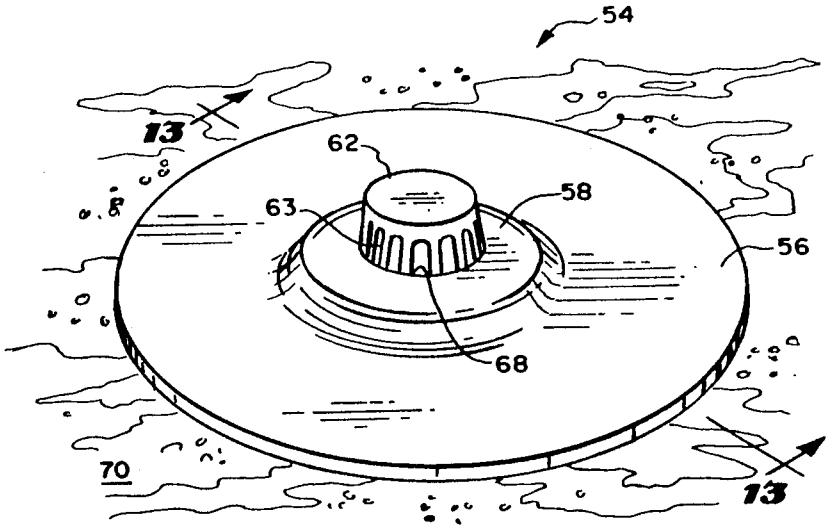
FIG. 12 is a top perspective view of the siphon head in FIG. 11 illustrating the way it is applied to an existing roof drain inlet.
Figure 13:
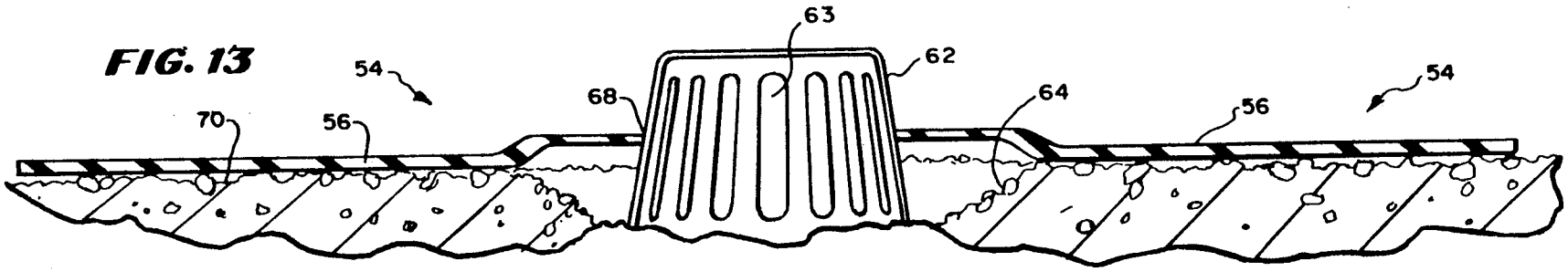
FIG. 13 is a cross-section on line 13—13 of FIG. 12 looking in the direction indicated by the arrows, showing the siphon head in conjunction with an existing roof drain inlet unit.

Another embodiment of a formed one-piece siphon head 54 is shown in FIG. 11 where the head or unit 54 consists of only a flat-bottomed foot-flange 56 having a centrally raised portion or hollowed out dome shaped head portion 58 of 3/16" thickness for easy cut out which portion 58 forms a cavity 60 on its underside. This siphon head is intended for use where a conventional roof drain or elements 62 already exists. Traditionally, these kinds of conventional drains 62 are prone to eventual clogging of their larger ports 63 which tend to capture leaves and debris in drain recesses or wells 64 (FIG. 13). By cutting an opening in the head or unit 54 to match the size and shape of the existing drain element 62, as indicated by the dotted line 65 on the thin head roof 66 (FIG. 11), the flat foot-flange 56 can be placed over the existing drain element 62 for a fairly tight fit at 68 (FIG. 13). Thus a different configuration of siphon head 54 is created with drain water being drawn beneath the foot-flange 56 instead of through the ports of the existing drain element. The straining of drain water is then accomplished, as in the previous embodiment, by the large area of minimal drainage passageways between the smooth-bottomed foot-flange 56 and a rough roof surface 70.

Figure 14:
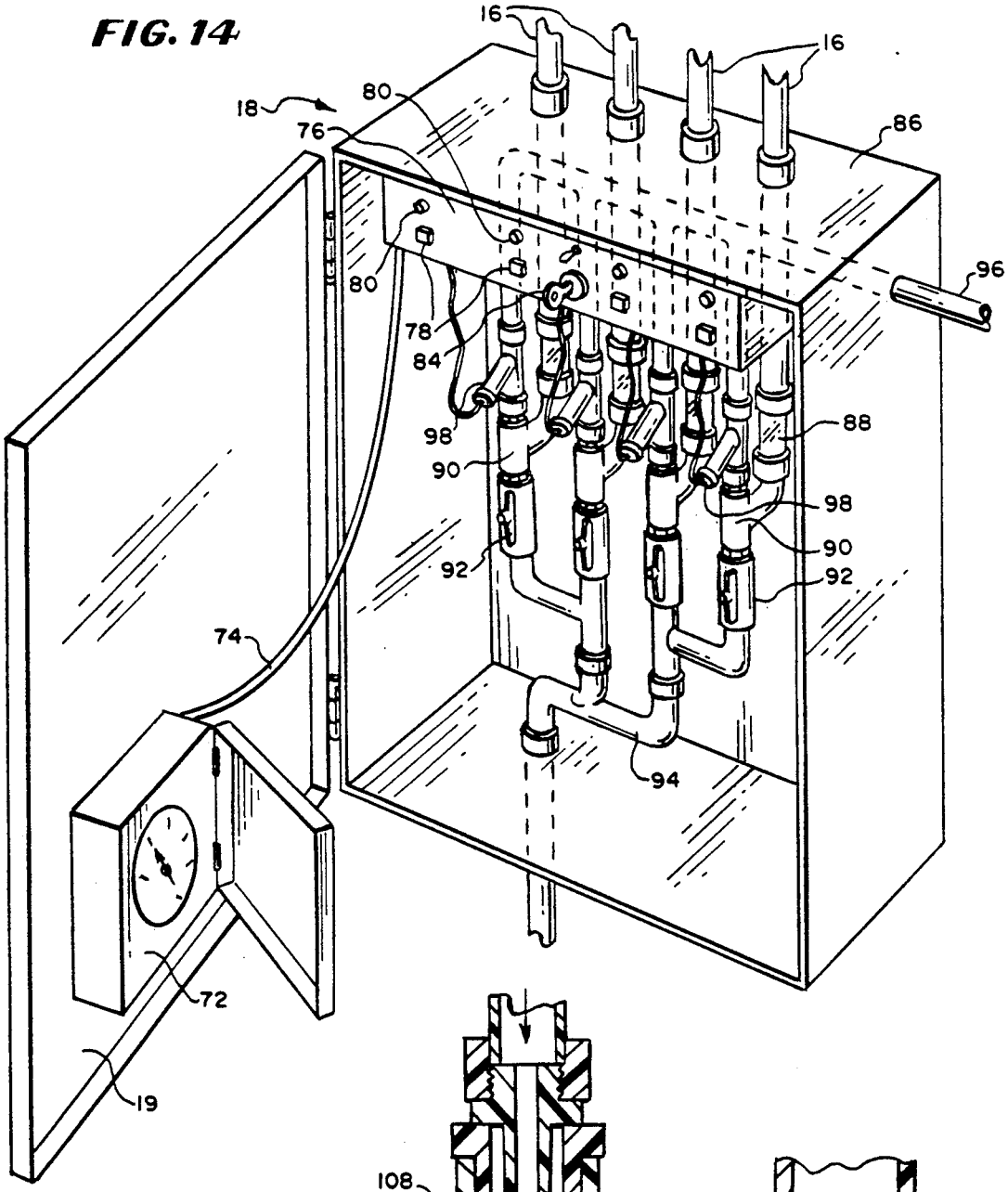
FIG. 14 illustrates a siphon valve housing in perspective, with the door open to reveal interior plumbing and component details illustrated in full and dotted lines in accordance with important features of my invention.

FIG. 14 illustrates the control valve housing 18 with its access door 19 opened to reveal the interior plumbing and positioning of various valves and controls. A timer or automatic timing device 72 is mounted on the control cabinet with a cable 74 bringing power which preferably is 24 volts from a 120 volt transformer behind the housing 18 to the timer 72 and back to a switch panel 76. Mounted on the switch panel 76 are push button switches 78 with indicator lights 80, an override switch at 82, and a key switch at 84. A toggle switch can be used if desired.

Upstanding pipes 16, leading downwardly from the roof drainage system of siphon heads and transfer pipes, enter a top 86 of the control valve housing or structure 18. The pipes 16 are connected to sight glasses 88 so that drain water flowing through the pipes also flow through the sight glasses 88 into pipe tees 90 which connect to manual discharge valves 92. Final drainage is through outlet pipes 94, connected as shown to the manual discharge valves 92. City water is admitted under a typical line pressure of 50–60 psi through pipe 96 (FIG. 14) to a row of four solenoid valves 98.

Figure 15:
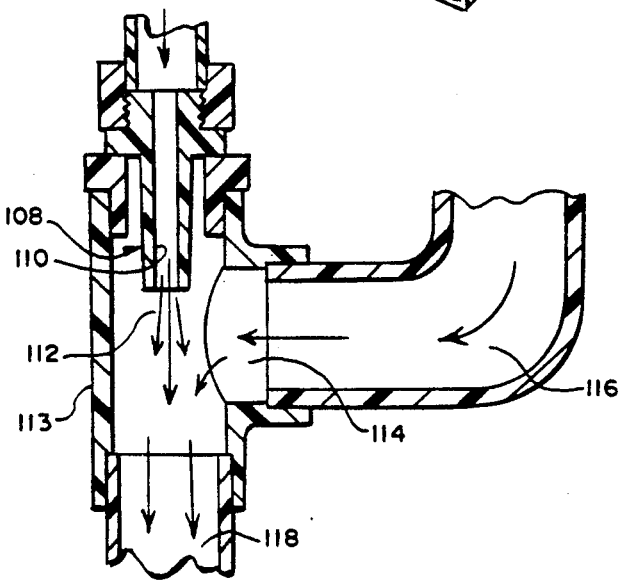
FIG. 15 is a fragmentary sectional view through a siphon pump device of FIG. 14 which utilizes a Venturi principle.
Figure 16:
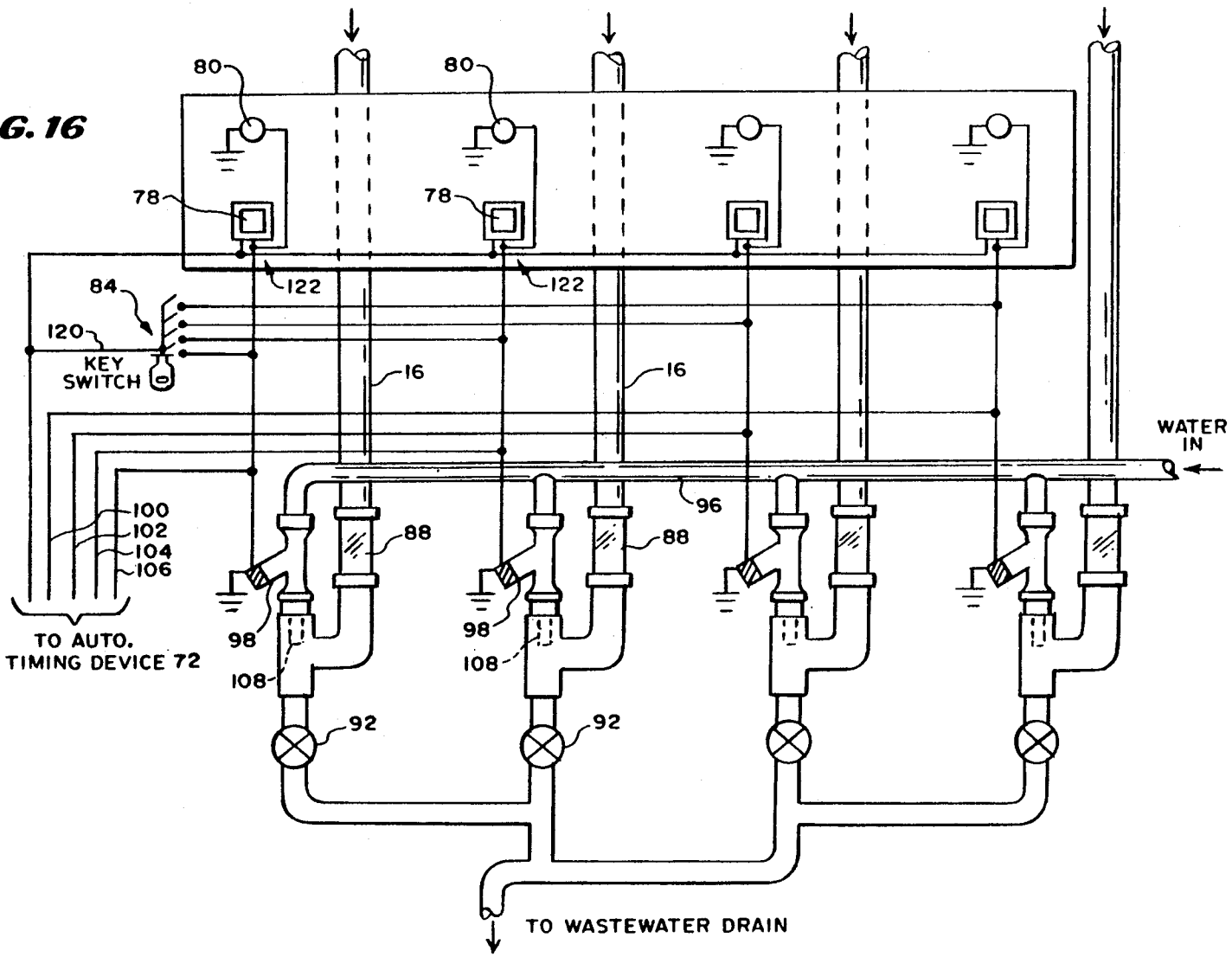
FIG. 16 schematically portrays the electrical circuitry for use with a roof drainage system as shown in the previous figures including FIG. 14 draining water from flat roofs through my plumbing configuration and a control panel therefore.

Referring now to FIG. 16, electrical power is supplied at timed intervals from the timer 72 (FIG. 15) to the solenoid valves 98 by the conductors 100, 102, 104, and 106. When the timer 72 is on and properly set for operating intervals of 3–4 minutes each from one to four times per day, the solenoid valves 98 are energized and switch open at the designated times to admit a surge of city water through siphon pump devices or pumps 108 (FIG. 16). During dry periods or at times when it is not deemed necessary to maintain this frequency of automatic monitoring (operation), the timer 72 can obviously be set for less frequent intervals, or even shut off. Likewise, in periods of heavy snow or rainfall, the frequency and interval can be increased.

When the solenoid valve 98 is opened and high-pressure city water is admitted to the siphon pump 108 (FIGS. 15 and 16), a small diameter restricted Jet Venturi passage or passageway 110 causes a pressure differential in the region 112 of pipe tee 113. This Venturi action across drain passage 114 draws drain water from the roof drainage system previously described through the elbow 116 into the discharge valve inlet at 118.

Where the water pressure is of the order of 50 lbs. per square inch or more in the city or village water system as received at commerical locations, excellent results can be attained where the jet has a ¼" orifice. It will be appreciated if the water pressure is other than stated, then other orifices may be required.

When it is desired to test the system by backflooding the roof or to flush the siphon heads by backwashing, the key switch 84 (FIGS. 14 and 16) in turned on and the override switch 82 can then be used for manual operation by holding the solenoid valves 98 open. Power is directed by conductor 120 (FIG. 16) to the manual switch circuits 122. It is essential that the manual discharge valves 92 (FIG. 14) be closed at this time so that the pressure water flow from city line 96 can pass through the open solenoid valves 98, back up the upstanding pipes 16 to the roof system. Individually, the push button switches 78 for each line can be pressed for activation, bringing that portion of the circuit into operation as indicated by the red lights at 80.

After an appropriate time interval, the system can be put back to the automatic mode to drain the flushing or backflooding water. The renewed drainage of this water can be observed by watching the sight glasses 88 to see that it is flowing clearly and uninterrupted. This avoids having to send a person to the roof to check the operation.

OPERATING SUMMARY

The basic operation of the system utilizes siphon principles. Looking at the drawings (FIGS. 14 and 16) it will be seen that the upper series of four valves 98 and the lower series of four valves 92. The solenoid valves 92 are hand operated. All of these eight valves are used for testing the system manually and back flushing the siphon lines in the event of any blockage either in the lines or the siphon heads on the roof top. They are not used in normal daily operation of this system which is fully automatic. In FIG. 14 you will note the lights 80 and the button switch 82. This switch 82 is to manually override the timing mechanism and used only to back flush or test the drainage system. The small red light 80 indicates during testing and normal operation that the solenoid valve 98 is open and this is the only function of this light. On a normal day the system time clock activates the solenoid 98 at a pre set time for three to four minutes which activates the three jet pumps promoting a siphoning action within each of the three lines thus removing any amount of water standing in those specific areas. The standing water is drained from its pond all the way down to the height of the gravel standing or embedded in tar roof top. If desired, the timer or clock 72 and solenoid valves 98 can be installed on the inside wall of this building. The water utilized by the jet pumps is connected to the city water supply within the building and is approximately 50 to 60 psi of pressure. The solenoid valves 98 and the timer or clock 72 control the beginning and stopping of this city water supply. When water is found to be standing on the roof as the systems function each day it is this siphon or jet effect which causes a strong vacuum to be created whereby a powerful suction is generated and pulls all the water from the roof top laterally along the water line and then downwardly along the side of the building and is drained out into the sewer.

It is understood that my invention is not confined to the particular construction and arrangement of parts herein illustrated and described, but embraces all such modified forms thereof as may come within the scope of the following claims.

I claim:

1. For use with a substantially flat horizontal roof having a pressurized city-type water line, the improvement of a roof draining system for draining away water that accumulates on the roof, a series of portable siphon heads which can be placed anywhere on the roof where there is a ponding area that no longer can be drained by any pre-existing water drainage system, the roof draining system including a series of upstanding pipes, a second series of roof top pipes each connected at one end to one of said siphon heads and each connected at an opposite end to one of said upstanding pipes, a control valve structure, the upstanding pipes connected to the control valve structure, the control valve structure involving a series of solenoid operated valves each connected to one of said upstanding pipes at one end, pipe means connected to each of said solenoid operated valves at one end, said pipe means being connectable with the pressurized city type water line, pipe tees each connected at one end to an associated one of said solenoid operated valves, manual discharge valves each connected at an opposite end of one of said pipe tees, an electrical timer operatively connected to each of said solenoid operated valves, siphon pumps each positioned in line with and operatively connected between one of said solenoid operated valves and the associated pipe tee, the timer being cooperable with solenoid operated valves at timed intervals to cause the solenoid operated valves to open thus permitting city water to pass through the solenoid operated valves and the associated siphon pump, the siphon pumps, each having a Venturi jet passageway therein which functions to generate a pressure differential in a region of said pipe tee causing roof water to be siphoned from the ponding areas on the roof into the associated upstanding pipe and then through a discharge valve inlet which flow continues from the roof ponds until the roof ponds are drained dry, said timer being operable at predetermined intervals to automatically shut off said solenoid operated valves after the interval expires.

2. The roof draining system as defined in claim 1 wherein the siphon head is comprised of a flat foot flange adapted to rest flatwise on a roof to be drained, the flange being annular, a dome shaped head portion centrally located and integrally formed with the relatively flat foot flange, the relatively flat foot flange extending outwardly in a relatively flat plane beyond the head portion and surrounding the head portion in all directions, the head portion being closed on its top side and having an interior cavity, an opening on an underside of the head portion in communication with the cavity for receiving fluids to be siphoned, and a discharge nozzle in fluid receiving communication with said interior cavity and extending radially away from said head portion atop said foot flange.

3. The roof draining system as defined in claim 1 wherein the siphon head has an interior cavity and an annular relatively flat foot flange, the flat foot flange has alternating radially extending lands and grooves, radially inner ends of the grooves opening into said interior cavity, and radially outer ends of the grooves extending through an outer perimeter of said annular relatively flat foot flange, the radially extending lands and grooves providing means for spacing the foot flange above a flat roof surface.

4. The roof draining system as defined in claim 1 wherein the siphon head has a relative flat radially extending foot flange, the flange having grooves which are each frusto-conical in configuration with radially inner ends being of a narrower arcuate configuration than radially outer ends of the grooves.

5. The roof draining system as defined in claim 1 wherein a flat foot flange is provided on said siphon head, the siphon head has a discharge nozzle, the siphon head being comprised of a soft pliable elastomeric material with a radially inner end of the nozzle being in fluid communication with the siphon head and with a radially outer end of the nozzle extending to a radially outer edge of said flat foot flange, and a plastic pipe being telescoped into said discharge nozzle for draining fluids.

6. The roof draining system as defined in claim 1 wherein sight glasses are mounted in the upstanding pipes upstream of said solenoid operated valves so that drain water flowing through the pipes also flow through the sight glasses into the pipe tees to advise the operator that pond water is being drained from the siphon heads.

7. The roof draining system as defined in claim 1 wherein switch means is provided for shutting down the automatic timing device to permit the manual discharge valves to be operated for permitting the pressurized city type water to be run through the system through the open solenoid valves back up the upstanding pipes and through the siphon heads for back flooding water.

8. The roof draining system as defined in claim 1 wherein the Venturi passageway has a ¼" orifice for use with the pressurized city type water line, the water line having a P.S.I. of at least 50 P.S.I.

9. A method of removing ponds of accumulated water from a flat roof where existing drainage systems are unable to reach new low roof spots lying beneath the ponds that have come into existence after the existing drainage system was installed, moving water drainage siphon heads to each of the ponds, connecting flexible water pipes to each of the siphon heads, connecting the flexible water pipes to a water drainage line, providing a Venturi jet having an orifice of an order of ¼" in fluid communication with each of the flexible water pipes, and causing pressurized water of an order of 50 P.S.I. to flow into each of the Venturi jets to generate a siphoning action in the flexible water pipes to suck water from each of the ponds to assist in draining of the ponds.

10. For use with a substantially flat horizontal roof having a pressurized city-type water line, the improvement of a roof draining system for draining away water that accumulates on the roof, a series of portable siphon heads which can be placed anywhere on the roof where there is a ponding area that no longer can be drained by any pre-existing water drainage system, the roof draining system including a series of upstanding pipes, a second series of roof top pipes each connected at one end of said siphon heads and each connected at an opposite end of said upstanding pipes, a control valve structure, the upstanding pipes being connected to the control valve structure, the control valve structure involving a series of solenoid operated valves each connected to one of said upstanding pipes at one end, pipe means connected to each of said solenoid operated valves at one end, said pipe means being connectable with the pressurized city type water line at an opposite end, pipe tees each connected at one end to an associated one of said solenoid operated valves, manual discharge valves each connected at an opposite end of one of said pipe tees, an electrical timer operatively connected to each of said solenoid operated valves, siphons each positioned in line with and operatively connected between one of said solenoid operated valves and the associated pipe tee, the timer being cooperable with solenoid operated valves at timed intervals to cause the solenoid operated valves to open thus permitting city water to pass through the solenoid operated valves and the associated siphons, the siphons each having a Venturi jet passageway therein which functions to generate a pressure differential in a region of said pipe tee causing roof water to be siphoned from the ponding areas on the roof into the associated upstanding pipe and then through a discharge valve inlet which flow continues from the roof ponds until the roof ponds are drained dry, said timer being operable at predetermined intervals to automatically shut off said solenoid operated valves after the interval expires, the siphon heads each being comprised of a soft pliable elastomeric including a relatively flat foot flange adapted to rest flatwise on a roof to be drained, the flange being annular, a dome-shaped head portion centrally located and integrally formed with the relatively flat foot flange, the relatively flat foot flange extending outwardly in a relatively flat plane beyond the head portion and surrounding the head portion in all directions, the head portion being closed on its top side and having an interior cavity, an opening on an underside of the head portion in communication with the cavity for receiving fluids to be siphoned, and a discharge nozzle in fluid receiving communication with said interior cavity and extending radially away from said head portion atop said foot flange, the discharge nozzle being integrally formed with the head portion and the foot flange and being in supported assembly therewith.

11. The roof draining system as defined in claim 10 wherein the flat foot flange is provided with a flat smooth surface on its under side for resting on top of a flat rough textured roof surface that is to be drained.

12. The roof draining system as defined in claim 10 wherein the annular relatively flat foot flange has alternating radially extending lands and grooves, radially inner ends of the grooves opening into said interior cavity, and radially outer ends of the grooves extending through an outer perimeter of said annular relatively flat foot flange, the radially extending lands and grooves providing means for spacing the foot flange above a flat roof surface.

13. The roof draining system as defined in claim 10 wherein the siphon head has a discharge nozzle formed integrally of the soft pliable elastomeric material with a radially inner end of the nozzle being in fluid communication with the head portion and with a radially outer end of the nozzle extending to a radially outer edge of said flat foot flange, and a plastic pipe being telescoped into said discharge nozzle for draining fluids located beneath said flat foot flange and the dome shaped head portion causing the fluid to moves upwardly through said interior cavity and then radially outwardly through said discharge nozzle.

14. The roof draining system as defined in claim 10 wherein sight glasses are mounted in the upstanding pipes upstream of said solenoid operated valves so that drain water flowing through the pipes also flow through the sight glasses into the pipe tees to advise the operator that pond water is being drained from the siphon heads.

15. The roof draining system as defined in claim 10 wherein switch means is provided for shutting down the automatic timing device to permit the manual discharge valves to be operated for permitting the pressurized city type water to be run through the system through the open solenoid valves back up the upstanding pipes and through the siphon heads for back flooding water.

16. The rough draining system as defined in claim 10 wherein the Venturi passageway has a ¼" orifice for use with the pressurized city type water line, the water line having a P.S.I. of at least 50 P.S.I.

* * * * *